United States Patent [19]

Hermanson

[11] 4,062,369

[45] Dec. 13, 1977

[54] DISPOSABLE RAIN AND WEATHER PROTECTOR

[76] Inventor: Terry Hermanson, c/o Mr. Christmas, Inc., 212 Fifth Ave., New York, N.Y. 10010

[21] Appl. No.: 699,638

[22] Filed: June 24, 1976

[51] Int. Cl.[2] ..... A45B 13/00; A45B 19/00

[52] U.S. Cl. ..... 135/19.5; 135/20 R

[58] Field of Search ..... 135/19.5, 20 R

[56] References Cited

U.S. PATENT DOCUMENTS

| | | | |
|---|---|---|---|
| 1,174,116 | 3/1916 | Berman | 135/19.5 X |
| 1,715,322 | 5/1929 | Foster | 135/19.5 |
| 1,783,972 | 12/1930 | Moses | 135/19.5 X |
| 2,241,389 | 5/1941 | Berman | 135/20 R |
| 2,667,884 | 2/1954 | Bruno et al. | 135/19.5 |

FOREIGN PATENT DOCUMENTS

| | | | |
|---|---|---|---|
| 1,487,735 | 5/1967 | France | 135/19.5 |

*Primary Examiner*—Werner H. Schroeder

*Assistant Examiner*—Conrad L. Berman

*Attorney, Agent, or Firm*—Karl W. Flocks

[57] ABSTRACT

A new and improved low cost disposable umbrella in particular one that is suitable for being conveniently stored or arranged in a stack or a vending machine to be dispensed therefrom in the manner that newspapers, shopping bags and the like are dispensed. The umbrella comprises a canopy, a canopy support, handle mechanism and lock mechanism for optionally securing the canopy in an open condition or permitting closing the umbrella. The canopy has a periphery in the form of a closed geometrical figure provided with radial fold lines dividing the canopy into at least one pair of opposed panels and at least two other pairs of opposed panels secured to the first pair of opposed panels. The canopy support is attached to the first pair of opposed panels but not to the other pairs of opposed panels. In the open condition of the umbrella, the canopy support supports the first pair of opposed panels attached thereto and holds the canopy in open condition.

20 Claims, 13 Drawing Figures

DISPOSABLE RAIN AND WEATHER PROTECTOR

BACKGROUND OF THE INVENTION

This invention relates to a disposable umbrella and more particularly to a flat folding umbrella type protector which may be made of inexpensive material such as corrugated board or other planar material such as cardboard and which may be folded, when closed, so that it may be conveniently stored or arranged in a stack and dispensed from an article dispensing machine in the manner that newspapers and shopping bags are dispensed.

Prior to the instant invention, there have been attempts at producing disposable umbrellas from simple planar materials, but such prior devices have not achieved acceptance in the trade and by the consumer because they are awkward to use, or they are too expensive to produce.

The umbrella in accordance with the invention can be made on automatic handling machines having gluing equipment and folding mechanism. The parts or elements of the umbrella are simply die cut. The operation of the disposable umbrella is simple and fool-proof. The umbrella is easy to hold when open, easy to store when closed and operates in a manner in which the comsumer expects it to operate.

DETAILED DESCRIPTION OF THE INVENTION

Figure 1:
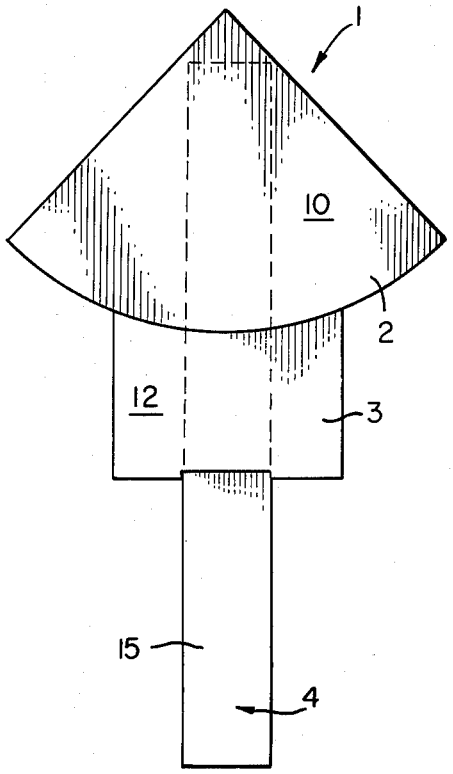
FIG. 1 shows an elevational view of the umbrella according to the present invention folded in storage or standby condition.
Figure 2:
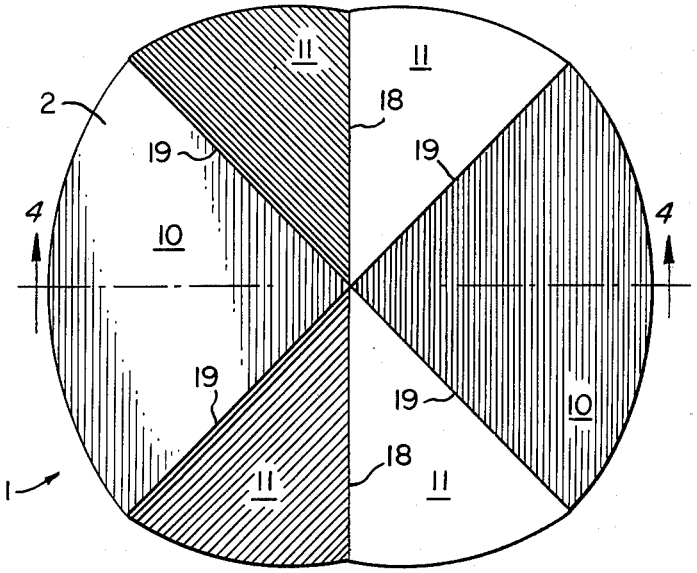
FIG. 2 is a top plan view of the umbrella in open condition.
Figure 3:
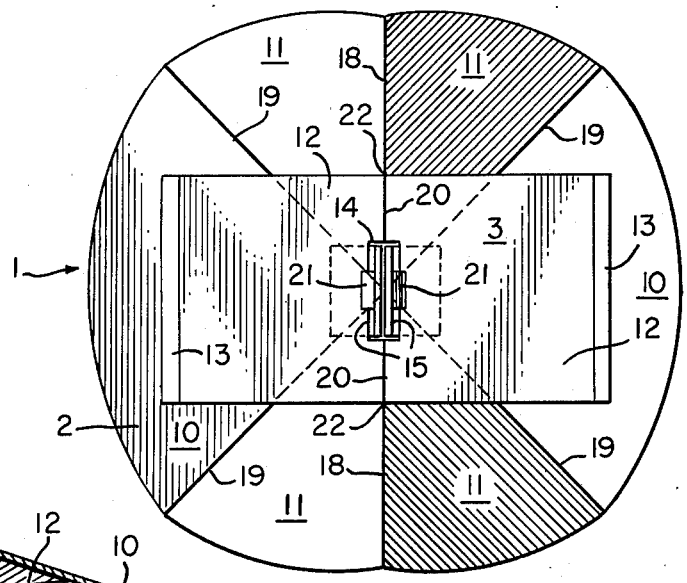
FIG. 3 is a bottom plan view of the umbrella in open condition.

Referring particularly to the drawings, one embodiment of the invention comprises the umbrella 1, according to FIGS. 1-5 includes a canopy 2 that is a die cut circle having two radial fold lines 18 and four radial fold lines 19, so as to produce two 90° panels 10 and four 45° panels 11 as clearly shown in FIGS. 2 and 3. Umbrella 1 further comprises a one piece canopy support 3 and a handle mechanism 4.

It is significant that the panels 11 are different from the panels 10 as when the umbrella is open, the canopy support 3 cooperates with the canopy 2 to support all of the panels 10 and 11.

Figure 4:
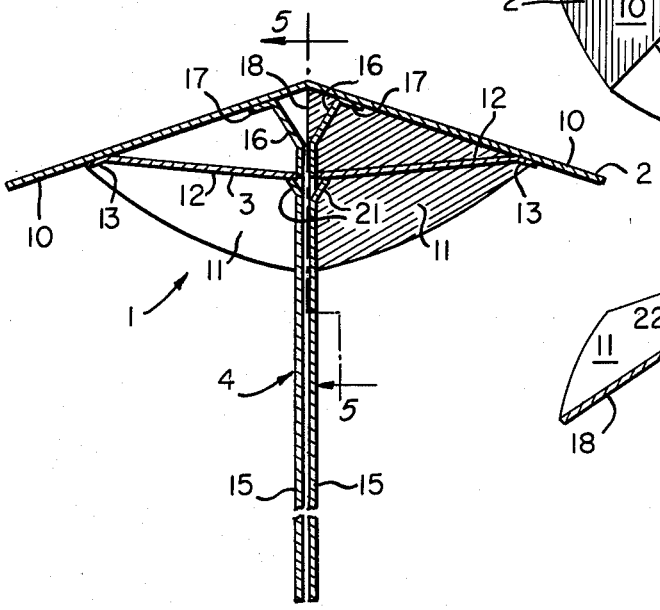
FIG. 4 is a view taken along section 4—4 in FIG. 2.
Figure 5:
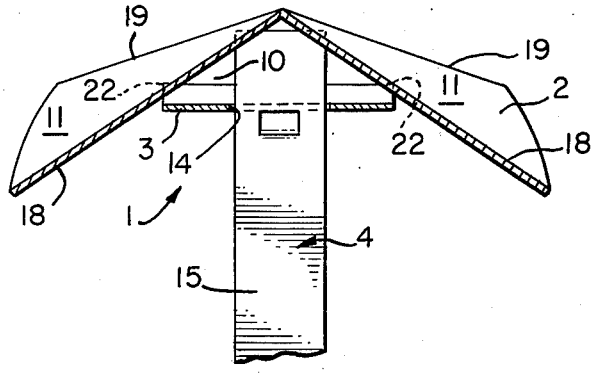
FIG. 5 is a view taken along section 5—5 in FIG. 4.

The canopy support 3 is a die cut simple planar sheet having a principal central fold line 20 and two principal panels 12 at the ends of which there are provided integral glue flap elements 13 or the like, which as may be seen in FIG. 4 extend under the canopy 2 and are fixedly secured to panels 10 of canopy 2. When it is desired to close the umbrella 1, the locking tabs 21 are pressed inwardly so that they are once more flush with the handle elements 15 and then the canopy support 3 may be lowered by pulling downwardly at fold line 20, for example, to close the umbrella 1 which will take the flat position illustrated in FIG. 1.

As may be seen in FIGS. 3 and 4 the radial fold lines 18 between each pair of the two pairs of panels 11 are generally coplanar with fold line 20 of canopy support 3 whereby as the umbrella 1 is closed, panels 12 of canpopy support 3 will fold downwardly about fold line 20 with portions of panels 11 adjacent to radial fold lines 18 being folded about fold lines 18 and movable inwardly between panels 12 of canopy support 3. The radial fold lines 19 defining one side of each of a panel 10 and a panel 11 of the canopy 2 facilitates folding the panels 11 inwardly therearound and between panels 10 and also the movement of panels 10 together to a folded generally flat condition as illustrated in FIG. 1.

In an alternative embodiment of the present invention according to FIGs. 6-10, the umbrella 1' includes a canopy 2' that is a die cut circle having two radial fold lines 18' and four radial fold lines 19', so as to produce two 90° panels 10' and four 45° panels 11' similar to corresponding elements in the embodiment of FIGS. 2 and 3. Umbrella 1' further comprises a canopy support 3' and a handle mechanism 4'.

The panels 11' of the alternative embodiment are also different from the panels 10' as when the umbrella is open, the canopy support 3' cooperates with the canopy 2' to support all of the panels 10' and 11'.

The canopy support 3' is a die cut simple planar sheet having a principal central fold line 20' and two principal panels 12' at the ends of which there are provided integral glue flaps 13'. As will be apparent from FIG. 9, the canopy support panels 12' support the canopy panels 10' at the location where the glue tabs 13' are secured thereto. The canopy support 3' is otherwise free from contact with the canopy panels 11' as may be seen in FIG. 10, without bearing points as in the embodiment of FIGS. 1-5 and supports canopy panels 11' only through their connection with canopy panels 10'. Thus it will be understood that canopy support 3', which initially is formed of a simple rectangular planar sheet, supports all six panels of the canopy 2' including the two 90° panels 10' and the four 45° panels 11'.

Figure 10:
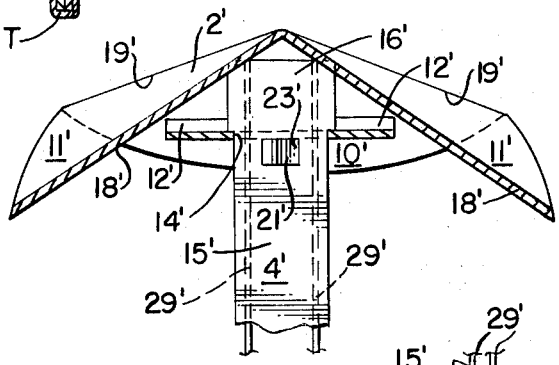
FIG. 10 is a view taken along section 10—10 in FIG. 9.
Figure 9:
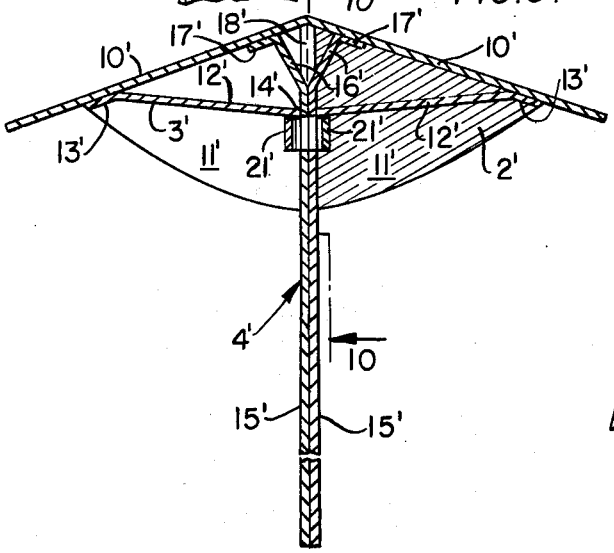
FIG. 9 shows a view similar to FIG. 4, but of the embodiment of FIG. 6.

When the canopy 2' of umbrella 1' is open and held erectly with handle mechanism 4' vertically, fold lines 18' are seen to extend above the planes of panels 10 as illustrated in FIGS. 9 and 10.

The canopy support 3' is provided with a central opening 14' through which handle elements 15', 15' of handle mechanism 4' extend. The handle elements 15', 15' at their upper ends, are provided with head extensions 16' and glue tabs 17' which are secured to the canopy as illustrated in the FIG. 9. Note in FIG. 10 that head extension 16' is wider than lower portions of handle element 15' and opening 14' so that upward movement of canopy support 3' is limited thereat. Heat extension 16' thus forms a facsimile T with the rest of handle element 15'.

The canopy support 3' may slide up and down over the handle elements 15', 15' to open and close canopy 2'. Canopy support 3' may be locked in open position by pulling the locking tabs 21', which initially are flush with the handle elements 15', out into the position shown in FIG. 9 so that they extend under the canopy support 3'. It is seen in FIG. 10 that lock tab 21' is generally rectangular and is integral with handle element 15' along a generally vertical hinge portion 23'. When it is desired to close the umbrella 1', the locking tabs 21' are pressed inwardly so that they are once more flush with the handle elements 15' and then the canopy support 3' may be lowered by pulling downwardly at fold line 20', for example, to close the umbrella 1' which will take the flat position illustrated in FIG. 6.

Figure 6:
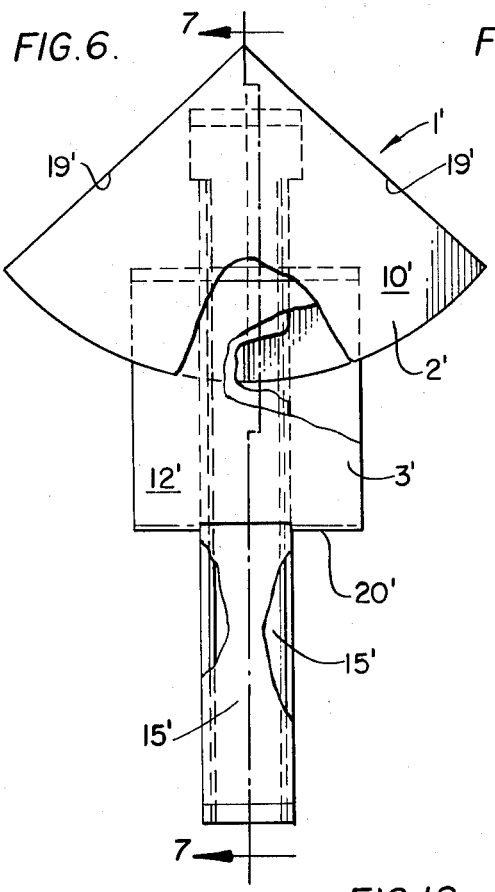
FIG. 6 shows a view similar to FIG. 1 of an alternative embodiment of the present invention.
Figure 7:
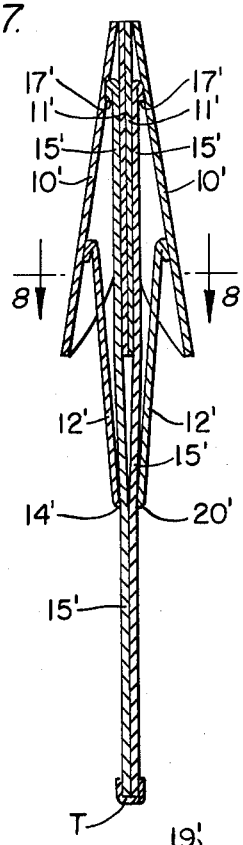
FIG. 7 is a view taken along section 7—7 in FIG. 6.
Figure 8:
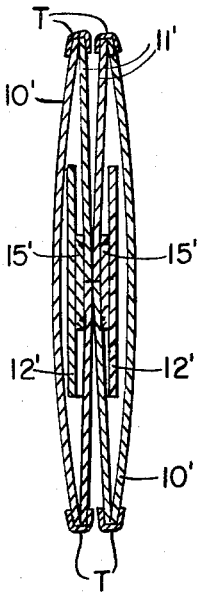
FIG. 8 is a view taken along section 8—8 in FIG. 7.

In the collapsed or closed condition of umbrella 1' as illustrated in FIGS. 6–8, canopy panels 10' are disposed on the outside with portions of panels 12' of canopy support 3' sandwiched therebetween, portions of handle elements 15' in turn sandwiched between the said portions of panels 12' and finally canopy panels 11' in turn sandwiched between said portions of handle elements 15''. Umbrella 1' may also be reinforced by strips of tape T along various edges as seen in FIGS. 7 and 8.

Figure 12:
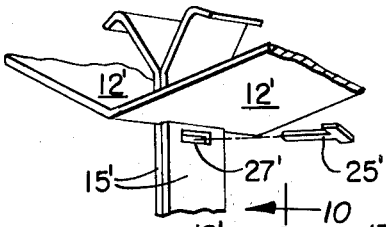
FIG. 12 is a view in perspective showing details of a locking device.

Other alternative features of the present invention may include a lock key 25' which may be inserted in slots 27' formed in handle elements 15' beneath support panels 12' as illustrated in FIG. 12.

Figure 13:
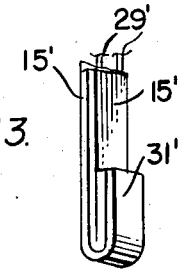
FIG. 13 is a view in perspective of the lower portion of a handle.
Figure 11:
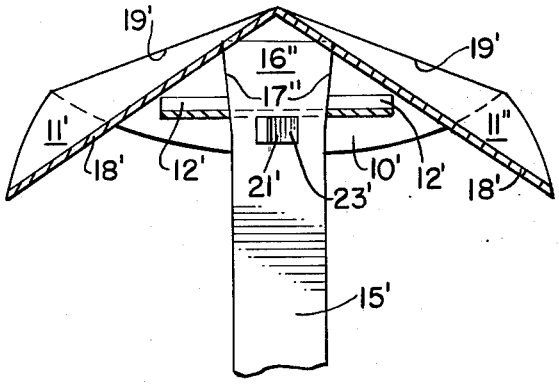
FIG. 11 is a view similar to FIG. 10 showing a variation in structure of the upper end of the handle element.

Further, alternative features of the present invention may include the incorporation of reinforcement within the material of handle elements 15' in the form of wires 29', or the like as seen in FIGS. 10 and 13. It is clear that such wires 29' terminate below heads 16' for optimum operatiion. Moreover, instead of the cross bar head 16' to form the letter T with elements 15' as seen in FIG. 10, handle elements 15' may be formed with a head extension 16'' having upwardly diverging sides 17'' above the opening 14' of canopy support 3'. Also, at the lower end of handle elements 15' a reversely folded portion 31' may be folded to provide a grip which may be secured to the main portion of handle element 15' by taping or by adhesive.

It will be obvious to those skilled in the art that various changes may be made without departing from the scope of the invention and the invention is not to be considered limited to what is shown in the drawings and described in the specification.

What is claimed is:

1. A disposable rain and weather protector comprising a canopy, a one-piece canopy support, handle means and lock means for the canopy support, said canopy having a periphery in the form of a closed geometrical figure and being provided with radial fold lines dividing the canopy into a plurality of panels and defining at least one pair of opposed panels and at least two other pairs of opposed panels, said at least one pair of opposed panels being fixedly secured to said canopy support, said at least two other pairs of opposed panels being secured to said first mentioned opposed panels along adjacent radial fold lines and extending above said canopy support when said canoy is in open position, said at least two other pairs of opposed panels extending freely above said canpy support and being otherwise unsecured thereto in the open position of said canopy, said first pair of opposed panels and said two other pairs of opposed panels all being supported by said canopy support when said canopy is in open position with support of said two other pairs of opposed panels being provided in their being secured to said first pair of panels, said handle means comprising generally vertically extending elements secured to said canopy and extending through an opening formed in said canopy support in slidable relationship therewith, said canopy support having a central fold line facilitating folding thereof, said handle elements being provided with said lock means for engaging said canopy support when the canopy is in open position and being movable into the plane of said handle elements when it is desired to close said canopy.

2. The structure as defined in claim 1 wherein said lock means comprise aligned slots in said handle elements and a key inserted in said slots.

3. The structure as defined in claim 1 wherein said canopy support is divided into two panels by said central fold line and each of said two panels of the canopy support is fixedly secured to said canopy at the free ends thereof.

4. The structure as defined in claim 3 wherein said structure is foldable into a collapsed condition with said first pair of opposed panels folded together along radial fold lines defining said first pair of opposed panels with said canopy support folded together along the central fold line thereof and having portions thereof sandwiched between said first pair of opposed panels, said handle elements having portions thereof sandwiched between said canopy support, and each of said other two pairs of opposed panels being folded together along a fold line generally coplanar with the central fold line of said canopy each of said pairs of opposed panels may have portions thereof folded in sandwiched relationship between said handle elements, said canopy support, and said first pair of opposed panels.

5. The structure as defined in claim 1 wherein said at least one pair of opposed panels each extend for an angle of about 90° around the canopy and each panel of said at least two other pairs of opposed panels extend for an angle of about 45° around the canopy.

6. The structure as defined in claim 5 wherein said canopy support includes a bearing point opposite edges thereof upon which said two other pairs of opposed panels rest in the open condition of said structure.

7. The structure as defined in claim 5 wherein said two other pairs of opposed panels extend above said canopy support freely and out of contact therewith in the open condition of said structure.

8. The structure as defined in claim 5 wherein said canopy is made of foldable corrugated cardboard or like material.

9. The structure as defined in claim 5 wherein said canopy support is made of foldable corrugated cardboard or like material.

10. The structure as defined in claim 5 wherein said canopy, said canopy support and said handle elements are all made of corrugated cardboard or like material.

11. The structure as defined in claim 1 wherein said lock means comprise at least one tab element integral with one of said handle elements and partially cut out from said one handle element.

12. The structure as defined in claim 11 wherein said tab element includes one generally vertical edge, a generally vertical hinge portion and two edges extending between said hinge portion and said generally vertical edge.

13. The structure as defined in claim 12 wherein said tab element is movable to an operative position to lock said canopy in an open position and to an idle position to permit closing the canopy.

14. The structure as defined in claim 5 wherein said handle elements are made of foldable corrugated cardboard or like material.

15. The structure as defined in claim 5 wherein said handle elements are formed with head portion of greater width than said opening in said canopy support to limit upward movement of said canopy support along said handle elements.

16. The structure as defined in claim 15 wherein said head portion and lower portion of said handle elements together form a facsimile T.

17. The structure as defined in claim 8 wherein opposite edges of said head portion diverge from each other in an upward direction above said opening.

18. The structure as defined in claim 15 wherein one or more reinforcing wire elements are disposed within said handle elements.

19. The structure as defined in claim 15 wherein said handle elements include a lower reversely folded portion to provide reinforcement thereat.

20. The structure as defined in claim 19 wherein one or more reinforcing wires extend within said handle elements to provide additional reinforcement.

* * * * *